US009223251B2

(12) United States Patent
Tuvesson et al.

(10) Patent No.: US 9,223,251 B2
(45) Date of Patent: Dec. 29, 2015

(54) TONER CARTRIDGE AND METHOD FOR REDUCING IMAGE ARTIFACT

(71) Applicant: Clover Technologies Group LLC, Ottawa, IL (US)

(72) Inventors: Eric Tuvesson, Newbury Park, CA (US); Frank Li, Walnut, CA (US)

(73) Assignee: CLOVER TECHNOLOGIES GROUP, LLC, Ottawa, IL (US)

( * ) Notice: Subject to any disclaimer, the term of this patent is extended or adjusted under 35 U.S.C. 154(b) by 0 days.

(21) Appl. No.: 14/275,185

(22) Filed: May 12, 2014

(65) Prior Publication Data

US 2015/0323887 A1 Nov. 12, 2015

(51) Int. Cl.
*G03G 15/08* (2006.01)

(52) U.S. Cl.
CPC ..... *G03G 15/0894* (2013.01)

(58) Field of Classification Search
CPC ..... G03G 2215/00987; G03G 15/0894
See application file for complete search history.

(56) References Cited

U.S. PATENT DOCUMENTS 5,867,755 A 2/1999 Sato
2004/0247346 A1 12/2004 Nakagawa
2012/0077116 A1* 3/2012 Hamaguchi et al. ..... 430/56
2012/0301189 A1 11/2012 Kase et al.
2013/0287451 A1* 10/2013 Yamamoto et al. ..... 399/281

FOREIGN PATENT DOCUMENTS

EP 1217468 6/2002
EP 2230561 9/2010

OTHER PUBLICATIONS

Fine Particle Silicone Resin Tospearl 3120, Momentive Performance Materials, http://www.momentive.com, Issued Jan. 2000/3rd revised May 2007, Japan.
Zonyl MP 1300, Technical Information by Dupont Fluoroproducts, www.teflon.com, Wilmington, Delaware.
European Search Report and Written Opinion, European Application No. 15166928.0, Sep. 1, 2015, 6 pages, European Patent Office, 80298 Munich, Germany.

* cited by examiner

*Primary Examiner* — Clayton E Laballe
*Assistant Examiner* — Ruifeng Pu
(74) *Attorney, Agent, or Firm* — Michael Best & Friedrich LLP

(57) ABSTRACT

A method of reducing an image artifact in a remanufactured toner cartridge. The method includes operating the remanufactured toner cartridge to transfer toner to a position between a developer roller and a metering blade of the remanufactured toner cartridge, the toner having a first formulation; and positioning a material having a second formulation different from the first formulation between the developer roller and the metering blade.

20 Claims, 4 Drawing Sheets

TONER CARTRIDGE AND METHOD FOR REDUCING IMAGE ARTIFACT

TECHNICAL FIELD

The invention generally relates to remanufactured printer cartridges, such as toner cartridges, and a method of remanufacturing printer cartridges.

BACKGROUND

Printing systems, such as high volume printing devices (e.g., network printers, photocopiers, etc.) typically use toner cartridges which store and transmit toner to an intended medium, such as paper. Once the toner has depleted, the used toner cartridge is removed from the printing system, and typically disposed of Remanufacturing of used toner cartridges permits the toner cartridges to be reused rather than disposed of in landfills.

Toner cartridges come in a variety of configurations. Although specific constructions vary among manufacturers and printers, many toner cartridges include components such as a toner hopper, a variety of toner-regulating blades, a developer roller, a primary charge roller, and an organic photo-conductor drum.

To avoid discarding useful materials and to thereby reduce the environmental impact of printing operations, many toner cartridges may be remanufactured. Remanufacturing involves collecting used toner cartridges that, prior to their use, were brand new cartridges typically supplied by the manufacturer of the printer with which the cartridges are compatible. These cartridges are often referred to in the art as "OEM cartridges" because they are supplied by the original equipment manufacturer, i.e., the manufacturer of the printer and the compatible printer cartridge.

Remanufacturing of toner cartridges typically includes, among other things, disassembling the toner cartridge, cleaning the toner cartridge, refilling the toner hopper with new toner, repairing or replacing worn or damaged components, and reassembling the toner cartridge. In many remanufacturing operations, toner and other components used in the remanufacturing process are sourced from suppliers other than those that supply the components of the OEM cartridge. Thus, a remanufactured cartridge is often a mix of previously used OEM cartridge components and new aftermarket components. As a result, when developing a remanufactured cartridge, substantial trial and error is often required before arriving at a combination of replacement components and toner that interact with the used OEM components in a way that provides acceptable print quality and page volume.

SUMMARY

In one embodiment, the invention provides a remanufactured toner cartridge including a toner hopper; a mass of toner stored within the toner hopper, the toner having a first formulation; a developer roller supported for rotation by the toner hopper, the developer roller having an outer surface and including a portion that faces into the toner hopper for gathering toner from the toner hopper; a metering blade including an edge facing the developer roller, a first side facing into the toner hopper, and a second side facing away from the toner hopper; and a material having a second formulation between the edge of the metering blade and the outer surface of the developer roller, the second formulation different from the first formulation.

In another embodiment the invention provides a method of reducing an image artifact in a remanufactured toner cartridge. The method includes operating the remanufactured toner cartridge to transfer toner to a position between a developer roller and a metering blade of the remanufactured toner cartridge, the toner having a first formulation; and positioning a material having a second formulation different from the first formulation between the developer roller and the metering blade.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
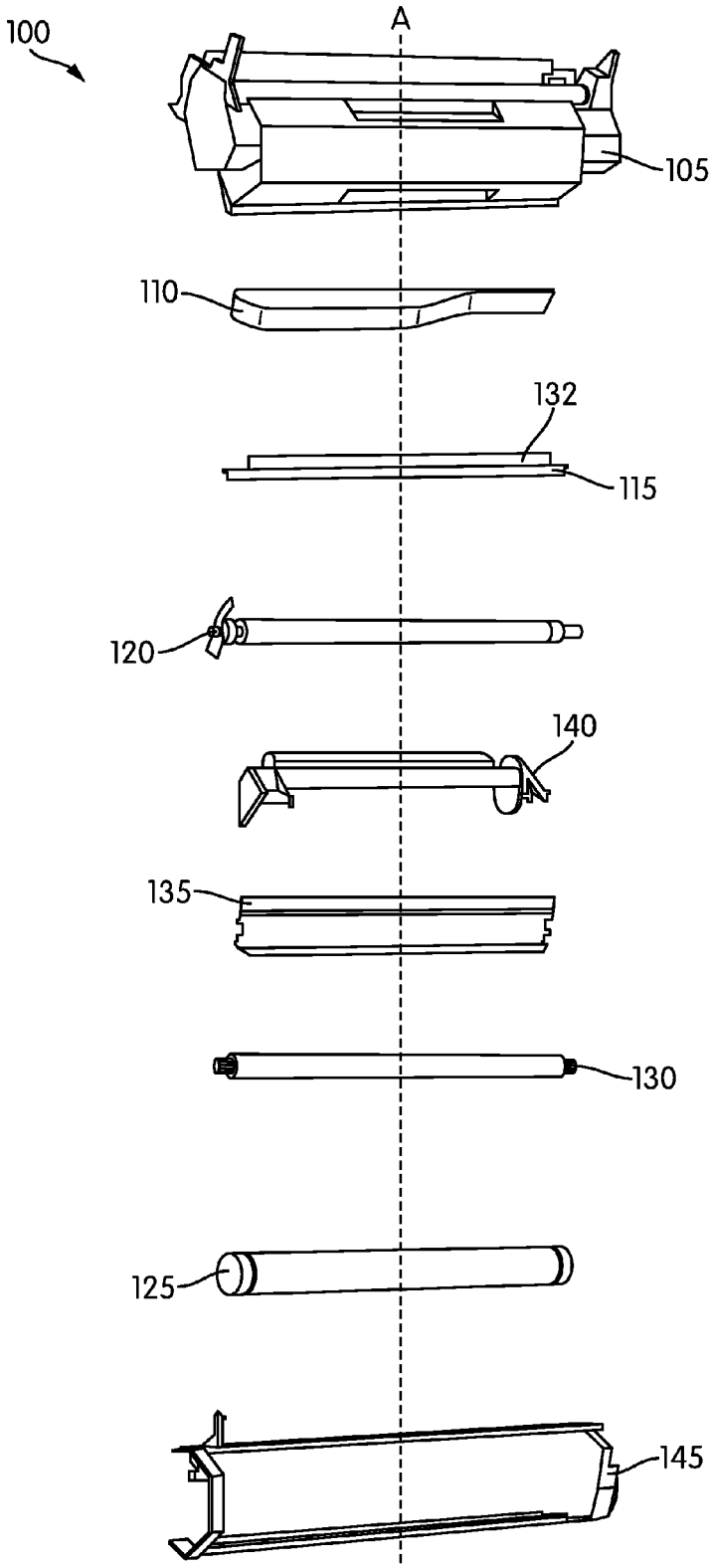
FIG. 1 illustrates an exploded view of a toner cartridge according to one embodiment of the invention.

FIG. 1 is an exploded view of a toner cartridge 100. The toner cartridge 100 is a consumable component used in a printing system (e.g., network printers, laser printers, photocopiers, etc.). The toner cartridge 100 stores and, in cooperation with components of a compatible printer, transfers toner to an intended medium (e.g., paper). Toner typically has a predetermined toner electrical potential, and is therefore attracted to elements or components having a different electrical potential. For example, toner may be attracted to components having a more negative, more positive, or opposite electrical potential relative to the toner electrical potential. Therefore, during printing, the toner can be transmitted via a series of progressively increasing, progressively decreasing, or opposite electrical potentials that "hand off" the toner from component to component.

The toner cartridge 100 includes a toner hopper 105 for storing a mass of toner having a first formulation. In some embodiments, the toner hopper 105 is provided with a seal 110. The seal 110 prevents toner from spilling prior to installation into the printing system. In some embodiments, the seal 110 is a removable protective strip.

The toner cartridge 100 of the illustrated embodiment is an "all-in-one" cartridge and further includes the following components or elements: a metering blade (e.g., a charge blade or doctor blade) 115; a developer roller (i.e., a magnetic roller or a developer unit) 120; an organic photo-conductor (OPC) drum 125; and a primary charge roller (PCR) 130. In other embodiments, the toner cartridge 100 may include more or fewer components. For example, alternative embodiments of the cartridge 100 may be developer cartridges that do not include an OPC drum or a PCR. In such embodiments, the OPC drum and PCR may be part of the printer or may be provided as a separately removable drum unit.

During operation, toner is collected from the toner hopper 105 by the rotating developer roller 120 and electrostatically transferred from the developer roller 120 to the OPC drum 125. A laser system having a laser beam, located within the printing system, scans an electrostatic image onto the OPC drum 125 with the laser beam. In some printers, the electrostatic image produced by the laser corresponds to the image to be printed. In other printers, the laser forms an electrostatic image that is a negative of the image that is to be printed. Regardless of the specific configuration, toner carried by the developer roller 120 is electrostatically attracted to the electrostatic image produced on the OPC drum 125 by the laser beam. The OPC drum 125 then applies the toner, which is in a pattern corresponding to the desired image, onto the intended medium by direct contact or by further electrostatic transfer. The toner is then fused to the intended medium, typically by way of a heating element (e.g., a fuser).

The toner cartridge 100 further includes a wiper blade 135. The wiper blade 135 remains in constant contact with the OPC drum 125 and wipes residual toner (i.e., toner remaining on the OPC drum 125 after transfer to the intended medium) from the OPC drum 125. The wiped residual toner is collected by a waste bin 140.

In some embodiments, the toner cartridge 100 further includes a drum shutter 145. The drum shutter 145 protects the OPC drum 125 from physical damage and exposure to light when the toner cartridge 100 is not installed in the printing system.

During remanufacturing, the toner cartridge 100 is disassembled. The components of the disassembled toner cartridge 100 are then cleaned and worn or damaged components are repaired or replaced. The toner hopper 105 is refilled with toner, and the toner cartridge 100 is then reassembled Often times after remanufacture of the toner cartridge 100, the toner cartridge 100 is operated one or more times before being sold to the end user. Operation of the toner cartridge 100 may include testing of the toner cartridge 100, such as but not limited to, post-testing the toner cartridge 100 for quality control purposes. A post-test includes installing the toner cartridge 100 in a printing system and using the printing system, along with the installed toner cartridge 100, to print one or more test pages in order to confirm proper operation of the remanufactured cartridge 100.

In some embodiments, the toner hopper 105 is provided with the seal 110 prior to post-testing. In such an embodiment, because the toner hopper 105 is sealed, toner does not transfer from the toner hopper 105 to the developer roller 120 during the post-test. Rather, prior to post-testing, the toner is applied to the developer roller 120. The toner cartridge 100 is then installed in a printing system and one or more test pages are printed in order to confirm proper operation of the remanufactured cartridge 100. In such an embodiment, the seal 110 is then removed before operation of the toner cartridge 100 by the end user.

Figure 2:
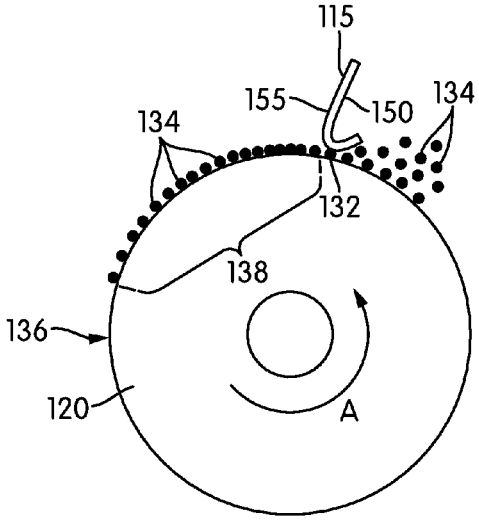
FIG. 2 illustrates a cross-sectional view taken along A of the assembled toner cartridge of FIG. 1.

Referring also to FIG. 2 the metering blade 115 includes an edge 132. The edge 132 is sized and positioned to apply a constant pressure on a narrow band of the developer roller 120 in order to form a uniformly thick layer of toner particles 134 on the developer roller 120. As toner passes between the edge 132 and the narrow band of the developer roller 120, a gap between the edge 132 and the developer roller 120 is created (the gap being approximately equal to the thickness of the layer of toner). As the developer roller 120 rotates in the direction of the arrow A, toner passes through the gap between the edge 132 of the metering blade 115 and the developer roller 120 and is arranged into a uniform layer of toner particles 134 on the surface of the developer roller 120 that is "downstream" of the metering blade 115. It should be appreciated that, for clarity of understanding, the drawings have been simplified to show a layer of toner that is a single toner particle thick. In reality the layer of toner is generally greater than the thickness of an individual toner particle.

FIG. 2 is an example of a condition of the developer roller 120 and metering blade 115 after a post-test operation. The metering blade 115 includes a first side 150 facing toward the toner hopper 105 and a second side 155 facing away from the toner hopper 105. After operation, an outer surface 136 of the developer roller 120 includes a band 138 that is covered in toner particles 134. The band 138 is outside the toner hopper 105 and on the second side 155 of the metering blade 115. Toner particles 134 are also present between the edge 132 of the metering blade 115 and the outer surface 136 of the developer roller 120. In some circumstances, if these toner particles 134 are maintained between the edge 132 of the metering blade 115 and the developer roller 120, the toner particles 134 can become strongly attached to the outer surface 136 of the developer roller 120. These strongly attached toner particles 134 may result in image artifacts, typically in the form of horizontal lines, on pages printed using the toner cartridge 100. One set of circumstances known to give rise to such image artifacts includes prolonged storage in the presence of high heat and humidity.

Figure 3:
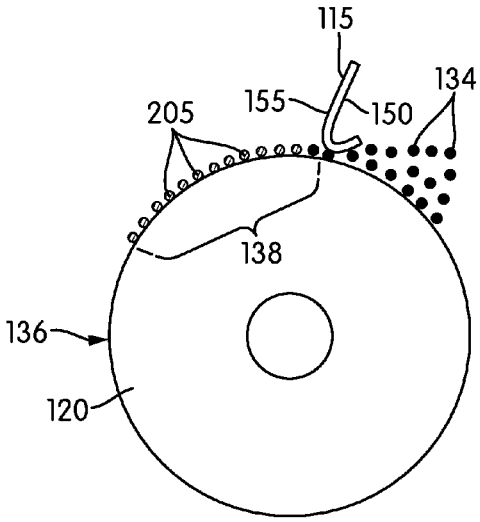
FIG. 3 illustrates a cross-sectional view taken along A of the assembled toner cartridge of FIG. 1.
Figure 4:
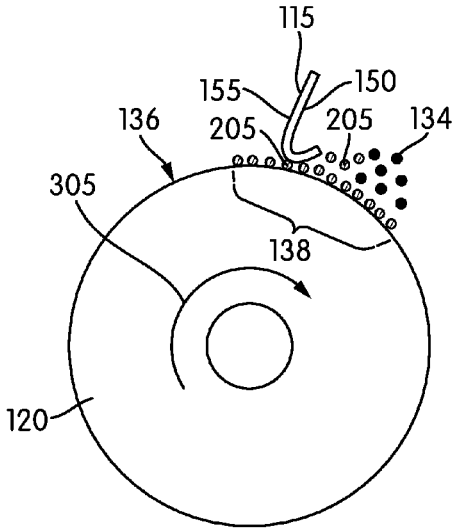
FIG. 4 illustrates a cross-sectional view taken along A of the assembled toner cartridge of FIG. 1.
Figure 5:
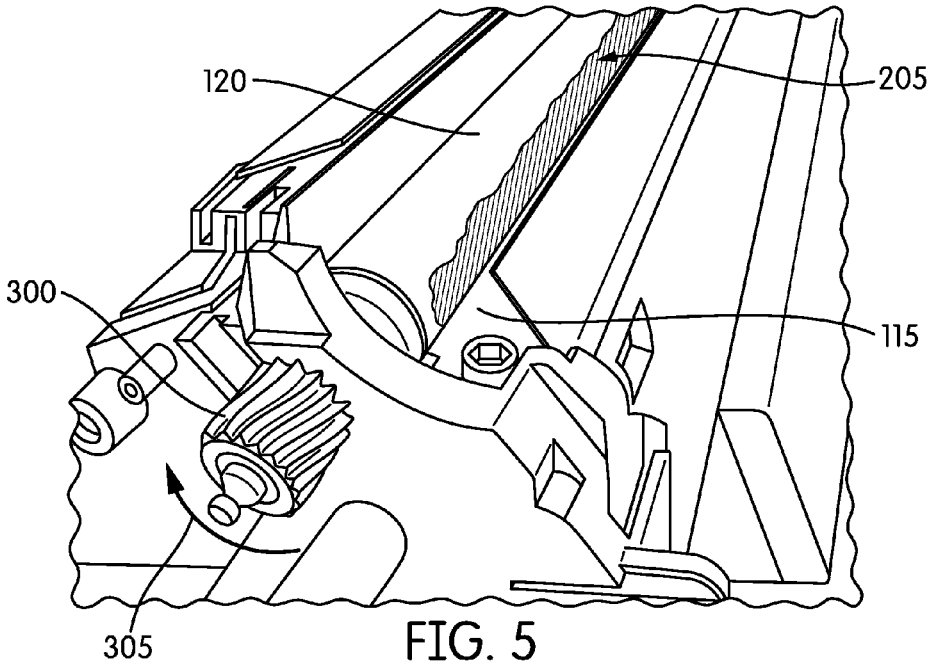
FIG. 5 illustrates a perspective view of the assembled toner cartridge of FIG. 1.

Referring also to FIGS. 3 through 5, to reduce the occurrence of image artifacts, a material 205 having different physical characteristics than the toner particles 134, e.g., a second formulation, may be placed between the edge 132 of the metering blade 115 and the developer roller 120. In some embodiments, the material 205 may have a lower affinity or adhesion tendency with respect to the developer roller 120. Placing the material 205 between the edge 132 of the metering blade 115 and the developer roller 120 may reduce the occurrence of image artifacts associated with toner particles 134 sticking to the developer roller 120. In the illustrated embodiment, the toner particles 134 between the edge 132 of the metering blade 115 and the developer roller 120 are removed before placement of the material. In other embodiments, the toner particles 134 between the edge 132 of the metering blade 115 and the developer roller 120 are not removed before placement of the material In some embodiments, the material 205 is a second toner having a substantially yellow color. The second toner may be an original equipment manufacturer toner having a substantially yellow color or another color. In some embodiments, the second toner may be mixed with a cyan, magenta, and/or black toner. In other embodiments, the material 205 includes a fluoroadditive, such as but not limited to, Zonyl® MP 1300. In other embodiments, the material 205 includes a silicone resin, such as but not limited to, a fine particle silicone resin. In some embodiments, the fine particle silicone resin includes a tospearl 3120 silicone resin. In still other embodiments, the material 205 may be a combination of two or more of the above materials. In another embodiment, the material 205 is a thin flexible material, such as but not limited to, ribbon or ribbon-like material that is removed before operation of the toner cartridge 100 by the end user.

With reference to FIGS. 3-5, following a post-test, toner particles 134 may be removed from the band 138, for example by wiping, and the material 205 may be applied to the band 138, for example using a brush or swab. FIGS. 3 and 5 illustrate the developer roller 120 after the material 205 has been applied to the band 138. In some embodiments, the material 205 may be applied to the band 138 without the additional step of removing the toner particles 134 because the mere addition of the material 205 is sufficient to reduce print defects. Once the material 205 has been applied to the developer roller 120, the developer roller 120 is back driven, i.e., rotated in a direction opposite the direction associated with normal operation of the cartridge, to position the material 205 between the developer roller 120 and the metering blade 115. In the illustrated embodiment, the cartridge 100 includes a driving gear 300 that may be rotated in the direction illustrated by arrow 305 in FIGS. 4 and 5 to back drive the developer roller 120. The developer roller 120 may be back driven manually or with an appropriate tool by way of the driving gear 300, by way of other gears, driving members, or rotatable components that may be provided on the cartridge 100, or by direct engagement with the developer roller 120 itself.

Figure 6:
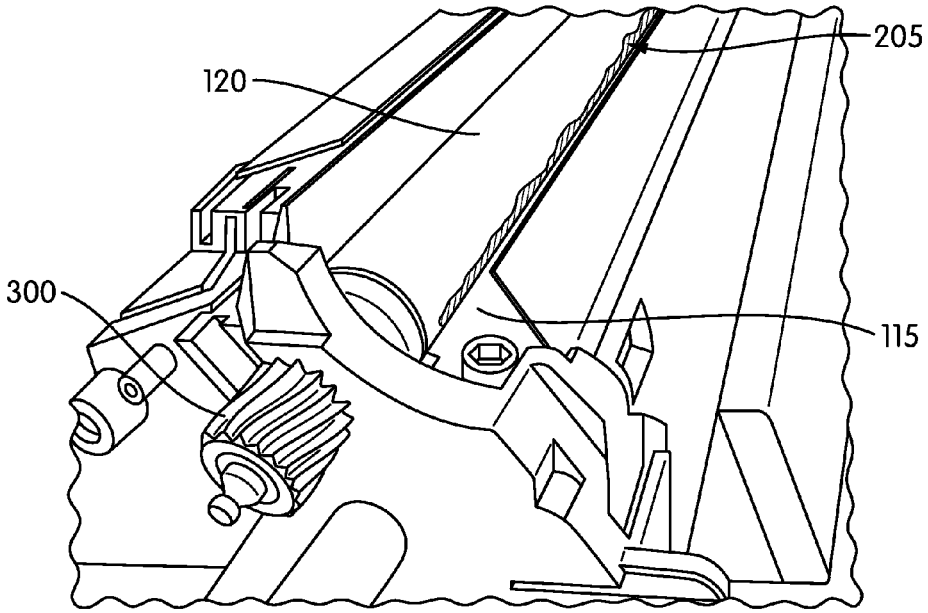
FIG. 6 illustrates a perspective view of the assembled toner cartridge of FIG. 1.

As illustrated in FIGS. 4 and 6, the developer roller 120 is rotated in the direction of the arrow 305 until the material 205 is moved to oppose the edge 132 of the metering blade 115, such that the material 205 is located between the edge 132 of the metering blade 115 and the developer roller 120. This also positions the band 138 such that a portion of the band 138 opposes the edge 132 of the metering blade 115. With the material 205 positioned between the edge 132 of the metering blade 115 and the outer surface 136 of the developer roller 120, the remanufactured toner cartridge 100 may be packaged and stored for prolonged periods with a reduced likelihood of print defects caused by material sticking to the developer roller 120. Upon use by the end user, the relatively small amount of material 205 is typically removed from the developer roller during the initial startup procedure of the printer and has little or no effect on subsequent printing operations.

Figure 7:
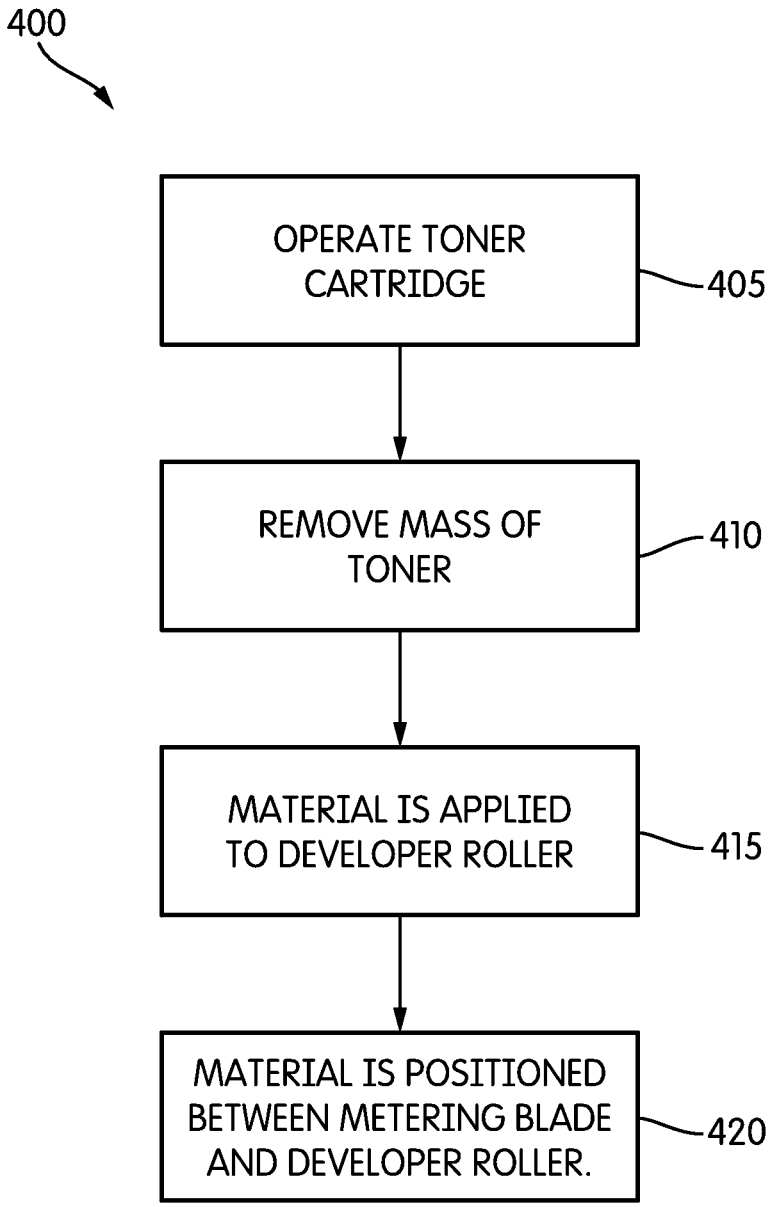
FIG. 7 illustrates a process of for reducing streaks or an image artifact of the toner cartridge of FIG. 1.

FIG. 7 is a flow-chart illustrating one exemplary process 400 for reducing image artifact in the toner cartridge 100. Other embodiments of the process 400 may include more or less steps, including steps discussed above. The toner cartridge 100 is operated (Step 405), for example by way of a post test, which positions toner particles 134 between the edge 132 of the metering blade 115 and the developer roller. The toner particles 134 are optionally removed from a portion of the developer roller 120 that is on the downstream side of the metering blade 115, such as band 138 (Step 410). Material 205 is applied to the portion of the developer roller 120 that is on the downstream side of the metering blade 115, such as the band 138, for example using a brush or swab (Step 415). The material 205 is positioned between the edge 132 of the metering blade 115 and the developer roller 120 (Step 420), for example by back-driving the developer roller 120 to position a portion of the band 138 in opposing relationship with the edge 132 of the metering blade.

Although the foregoing description refers to remanufactured toner cartridges 100, the invention may also be applied to newly manufactured toner cartridges. Thus, the invention provides, among other things, an improved remanufactured toner cartridge, an improved toner cartridge, and an improved method for reducing image artifacts in remanufactured or newly manufactured toner cartridges. Various features and advantages of the invention are set forth in the following claims.

What is claimed is:

1. A method of reducing an image artifact during printing using a remanufactured toner cartridge, the method comprising:

post testing the remanufactured toner cartridge to transfer toner to a position between a developer roller and a metering blade of the remanufactured toner cartridge, the toner having a first formulation; and positioning a material having a second formulation different from the first formulation between the developer roller and the metering blade.

2. The method of claim 1, wherein positioning the material having the second formulation between the developer roller and the metering blade includes replacing the toner with the material.

3. The method of claim 1, wherein the material having the second formulation includes a toner having a substantially yellow color.

4. The method of claim 1, wherein the material having the second formulation includes a fluoroadditive.

5. The method of claim 1, wherein the material having the second formulation includes a silicone resin.

6. The method of claim 1, wherein positioning the material having the second formulation between the developer roller and the metering blade includes back-driving the developer roller.

7. The method of claim 1, wherein positioning the material having the second formulation between the developer roller and the metering blade includes, after post testing the remanufactured toner cartridge, applying the material having the second formulation to a portion of the developer roller that is outside a toner hopper and on a first side of the metering blade.

8. The method of claim 7, wherein positioning the material having the second formulation between the developer roller and the metering blade further includes back-driving the developer roller such that the portion of the developer roller with the material having the second formulation applied is moved to oppose an edge of the metering blade, the edge of the metering blade facing towards the developer roller.

9. The method of claim 7, wherein positioning the material having the second formulation between the developer roller and the metering blade further includes removing toner from the portion of the developer roller before applying the material having the second formulation to the portion of the developer roller.

10. The method of claim 7, wherein the toner comprises a first toner, and wherein the material having the second formulation comprises a second toner.

11. The method of claim 1, wherein the toner comprises an aftermarket toner and the material having the second formulation comprises an original equipment manufacturer toner.

12. A remanufactured toner cartridge comprising:

a toner hopper;

a mass of toner stored within the toner hopper, the toner having a first formulation;

a developer roller supported for rotation by the toner hopper, the developer roller having an outer surface including a portion that faces into the toner hopper for gathering toner from the toner hopper;

a metering blade including an edge facing the developer roller, a first side facing into the toner hopper, and a second side facing away from the toner hopper; and a material having a second formulation between the edge of the metering blade and the outer surface of the developer roller, the second formulation being different from the first formulation;

wherein the outer surface further includes a band that is outside the toner hopper and on the second side of the metering blade upon completion of a post test of the toner cartridge; and wherein a portion of the band faces the edge of the metering blade upon completion of an operation following the post test.

13. The toner cartridge of claim 12, wherein the material having the second formulation includes a toner having a substantially yellow color.

14. The toner cartridge of claim 12, wherein the material having the second formulation includes a fluroadditive.

15. The toner cartridge of claim 12, wherein the material having the second formulation includes a silicone resin.

16. The toner cartridge of claim 12, wherein the mass of toner stored within the toner hopper comprises a first toner, and wherein the material having the second formulation comprises a second toner.

17. The toner cartridge of claim 12, wherein the toner comprises an aftermarket toner and the material having the second formulation comprises an original equipment manufacturer toner.

18. The toner cartridge of claim 12, wherein the material having the second formulation comprises an original equipment manufacturer yellow toner.

19. The toner cartridge of claim 12, wherein the material having the second formulation is located between the edge of the metering blade and the portion of the band.

20. The toner cartridge of claim 12, wherein the operation includes back-driving the developer roller.

* * * * *